US007406396B2

(12) United States Patent
Das et al.

(10) Patent No.: US 7,406,396 B2
(45) Date of Patent: Jul. 29, 2008

(54) SYSTEM AND METHOD FOR ONLINE END POINT DETECTION FOR USE IN CHEMICAL MECHANICAL PLANARIZATION

(75) Inventors: Tapas K Das, Tampa, FL (US); Rajesh Ganesan, Tampa, FL (US); Arun K Sikder, Tampa, FL (US); Ashok Kumar, Tampa, FL (US)

(73) Assignee: University of South Florida, Tampa, FL (US)

( * ) Notice: Subject to any disclaimer, the term of this patent is extended or adjusted under 35 U.S.C. 154(b) by 179 days.

(21) Appl. No.: 11/164,048

(22) Filed: Nov. 8, 2005

(65) Prior Publication Data

US 2006/0100821 A1 May 11, 2006

Related U.S. Application Data

(63) Continuation of application No. 60/626,026, filed on Nov. 8, 2004.

(51) Int. Cl.
*G06F 15/00* (2006.01)
*G01N 31/00* (2006.01)

(52) U.S. Cl. ..... 702/181; 702/30

(58) Field of Classification Search ..... 702/30, 702/76, 77, 179, 181; 73/587; 216/84
See application file for complete search history.

(56) References Cited

U.S. PATENT DOCUMENTS 6,397,679 B1 * 6/2002 Sadok et al. ..... 73/596
6,431,953 B1 * 8/2002 Carter et al. ..... 451/5
2005/0223805 A1 * 10/2005 Ganesan et al. ..... 73/587

OTHER PUBLICATIONS

Tapas K. Das et al., Online End Point Detection in CMP Using SPRT of Wavelet Decomposed Sensor Data, IEEE Transactions of Semiconductor Manufacturing, vol. 18, No. 3, Aug. 2005.

* cited by examiner

*Primary Examiner*—Bryan Bui
(74) *Attorney, Agent, or Firm*—Anton J. Hopen; Smith & Hopen, P.A.

(57) ABSTRACT

The present invention is an online methodology for end point detection for use in a chemical mechanical planarization process which is both robust and inexpensive while overcoming some of the drawbacks of the existing end point detection approaches currently known in the art. The present invention provides a system and method for identifying a significant event in a chemical mechanical planarization process including the steps of decomposing coefficient of friction data acquired from a chemical mechanical planarization process using wavelet-based multiresolution analysis, and applying a sequential probability ratio test for variance on the decomposed data to identify a significant event in the chemical mechanical planarization process.

14 Claims, 9 Drawing Sheets

(a)

(b)

SYSTEM AND METHOD FOR ONLINE END POINT DETECTION FOR USE IN CHEMICAL MECHANICAL PLANARIZATION

CROSS REFERENCE TO RELATED APPLICATIONS

This application claims priority to U.S. Provisional Patent Application No. 60/626,026, having the same title and inventorship, filed Nov. 8, 2004, which is incorporated herein by reference.

STATEMENT OF GOVERNMENT SUPPORT

This invention was made with government support under DMI0330145 awarded by the National Science Foundation. The government has certain fights in the invention.

BACKGROUND OF INVENTION

Wafer polishing using chemical mechanical planarization (CMP), as shown with reference to FIG. 1, is a key nanoscale manufacturing process that can significantly impact critical requirements facing the semiconductor device manufacturing procedure. Some of these requirements for nanoscale manufacturing include continual feature size reduction, introduction of new materials for higher processing speeds and improved reliability, multilevel metallization (MLM) or interconnections, and increased productivity through larger wafer sizes. The CMP task has been made more challenging in recent years by complex wafer topographies, and the introduction of copper, as a substitute for aluminum, and low-k dielectrics. Some of the difficult manufacturing challenges of CMP include defects identification, such as delamination, dishing, and erosion, end point detection (EPD) and process control.

End point detection (EPD) is the determination of the end of polishing in a chemical mechanical planarization (CMP) process. FIG. 2 illustrates the CMP process and its associated end point as known in the art. If the end point is not detected properly, a defect in the chemical mechanical planarization process for metals, oxides, or dielectrics, known as over and underpolishing, may result. One primary reason for this defect may be the change in material removal rate (MRR) often caused by normal polish pad life cycle, variations in the slurry, variations in the polishing pad, and conditioning issues of pads. Other reasons for over and under polishing may include approximations of empirical MRR calculations and fluctuations in incoming oxide or metal layer thickness. Accordingly, EPD of CMP is a critical operational issue.

Literature in the field of EPD and CMP cites the need for accurate end point detection of a chemical mechanical planarization process involved in three different processes of wafer fabrication, including copper damascene, shallow trench isolation (STI), and interlevel dielectrics (ILD). Some of the challenges known in the art for EPD include: 1) inaccessibility to the entire wafer surface for measurements during polishing; 2) high cost of metrology; 3) difficulty in implementing online methodologies; 4) inaccurate interpretation of in-situ sensor data; and 5) lack of robustness of the detection methodology. Current approaches to EPD are include the analysis of both offline and in-situ sensor data. Offline methods are referred to as dry methods, and include processes in which the wafer is inspected under a microscope to determine its polishing status. Though this method has the advantage of a thorough microscopic level analysis, it is not conducive to higher productivity because the planarization process must be stopped to evaluate the wafer. Additionally, offline methods are expensive due to their cost of ownership.

The in-situ sensor methods known in the art, also referred to as wet methods, include optical, thermal, electric, electrochemical and acoustic emission sensor systems. Optical sensor-based methods known in the art employ interferometry, reflectance and spectral reflectivity, and ellipsometry to acquire thickness measurements. In these methods, a beam of light is passed through the wafer and the wavelength of light emitted from the wafer surface is measured. The wavelength is then used to evaluate the thickness of the wafer and, in turn, detect the end point of polishing. This method becomes inefficient, especially with metal CMP, as the wafer thickness grows. Cu, for example, is optically transparent to only about 30 nm. On patterned ILD wafers, optical methods present additional challenges, such as diffraction, which significantly affects the spectral analysis. Environmental factors such as sensing through air, slurry, and glass during in-situ measurements also affects the performance of optical methods for end point detection currently known in the art.

Thermal systems for end point detection in CMP utilize infrared temperature measurements and changes in temperature to detect an end point. In these thermal systems known in the art, a change in temperature can result from either the change in friction of the wear mechanisms or in the underlying chemical reactions. The major disadvantage of thermal methods for EPD is difficulty in implementation. Implementation is difficult because the infrared sensors have to be fixed onto a transparent pad or be positioned to rotate with the carrier to be able to accurately detect the temperature change. This configuration is difficult to implement in the manufacturing process. Additionally, small changes in temperature values that are difficult to detect, such as those often caused by the presence of thermally diffusive materials, present a significant challenge to thermal EPD detection systems.

Friction based methods for EPD in CMP use motor-current sensing techniques. These techniques are also highly dependent on process parameters and consumables, and become inefficient for polishing ILD, in which there is no transition to an underlying layer with a different coefficient of friction.

Monitoring the material removal rate (MRR) in the CPD process is another alternative for EPD. In this method, an x-ray beam is directed on the downstream slurry and a detector monitors the induced fluorescence. The fluorescence indicates the density of abrasive in the slurry, which is then used in MRR calculations. Though in principal this method works, it has been proven to be ineffective.

Electrochemical methods for EPD measure the electrochemical potential between a measurement electrode, which is either the surface being polished or a probe inserted into the slurry near the wafer, and the reference electrode.

Another approach to EPD in CMP is chemical EPD, which is suitable for polishing wafers with nitride in the second layer. The detection procedure relies on measuring the concentration of nitrous oxide emitted when the end point is reached.

Acoustic emission (AE) and coefficient of friction (CoF) sensors are known in the art to be used in process monitoring for EPD by measuring various properties including the amplitude of the emitted signal, and the frequency of the spectral peaks. Since these properties differ between materials, they can be used to detect transitions from one layer to another during CMP. The presence of noise and the need for advanced signal processing has kept these approaches from being commercially implemented.

Efficient EPD in CMP has been an open research issue since the introduction of CMP to the wafer fabrication process. Several approaches have been proposed in the literature of which only a few rely upon the signals (AE and CoF) obtained directly from the molecular interactions of the polishing process. However, these signals by themselves cannot characterize important process events, like end point. Accordingly, what is needed in the art is an improved end point detection methodology for CMP that is robust and efficient and also capable of real-time implementation.

SUMMARY OF INVENTION

The present invention is an online methodology for end point detection for use in a chemical mechanical planarization process which is both robust and inexpensive while overcoming some of the drawbacks of the existing end point detection approaches currently known in the art.

In accordance with the present invention is provided a method of identifying a significant event in a chemical mechanical planarization process, the method including the steps of decomposing coefficient of friction data acquired from a chemical mechanical planarization process using wavelet-based multiresolution analysis and applying a sequential probability ratio test for variance on the decomposed data to identify a significant event in the chemical mechanical planarization process.

In a particular embodiment, the step of decomposing coefficient of friction data acquired from a chemical mechanical planarization process using wavelet-based multiresolution analysis further includes, wavelet decomposing the coefficient of friction data acquired from the chemical mechanical planarization process into wavelet coefficients reconstructing the wavelet coefficients into time-domain wavelet details.

Prior to decomposing the coefficient of friction data, the acquired coefficient of friction data is grouped into at least one nonoverlapping data block having a predetermined dyadic length and determining a level of decomposition for the decomposition of the coefficient of friction data. The level of decomposition may be determined by applying a threshold rule to the coefficient of friction data, observing the data to identify significant coefficients and subsequently determining the level of decomposition based on the identified significant coefficients. In a specific embodiment, the threshold rule is Donoho's universal threshold rule.

In a specific embodiment, the sequential probability ratio test for variance applied to the decomposed wavelet data is Wald's sequential probability ratio test for variance.

Various chemical mechanical planarization processes, where there is a transition from one material to another, are within the scope of the present invention. These CMP processes include, but are not limited to, oxide chemical mechanical planarization and metal chemical mechanical planarization.

Additionally, various significant events may be detected by the method in accordance with the present invention. These significant events include an end point in the chemical mechanical planarization process, a starting point of an end point in the chemical mechanical planarization process, an ending point of an end point in the chemical mechanical planarization process and a transition from one material to another in the chemical mechanical planarization process.

In an additional embodiment of the present invention, a computer-implemented process for identifying a significant event in a chemical mechanical planarization process is provided. The computer-implemented process includes the steps of wavelet decomposing the coefficient of friction data acquired from a chemical mechanical planarization process into wavelet coefficients, reconstructing the wavelet coefficients into time-domain wavelet details and applying a sequential probability ratio test for variance on the time-domain wavelet details to identify a significant event in the chemical mechanical planarization process.

In addition to the methods provided, the present invention additionally includes a system for identifying a significant event in a chemical mechanical planarization process, the system includes a decomposer for wavelet decomposing the coefficient of friction data acquired from a chemical mechanical planarization process into wavelet coefficients and reconstructing the wavelet coefficients into time-domain wavelet details and a sequential probability ratio tester for applying a sequential probability ratio test for variance on the time-domain wavelet details to identify a significant event in the chemical mechanical planarization process.

In an additional embodiment, an identifier for identifying a significant event in a chemical mechanical planarization process stored via storage media is provided. The storage media in accordance with the present invention including a first plurality of binary values for wavelet decomposing the coefficient of friction data acquired from a chemical mechanical planarization process into wavelet coefficients and for reconstructing the wavelet coefficients into time-domain wavelet details and a second plurality of binary values for applying a sequential probability ratio test for variance on the time-domain wavelet details to identify a significant event in the chemical mechanical planarization process.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In accordance with an embodiment of the present invention is provided an online methodology for end point detection which is comprised of online CoF data decomposition followed by end point detection using a sequential probability ratio test.

Figure 1:
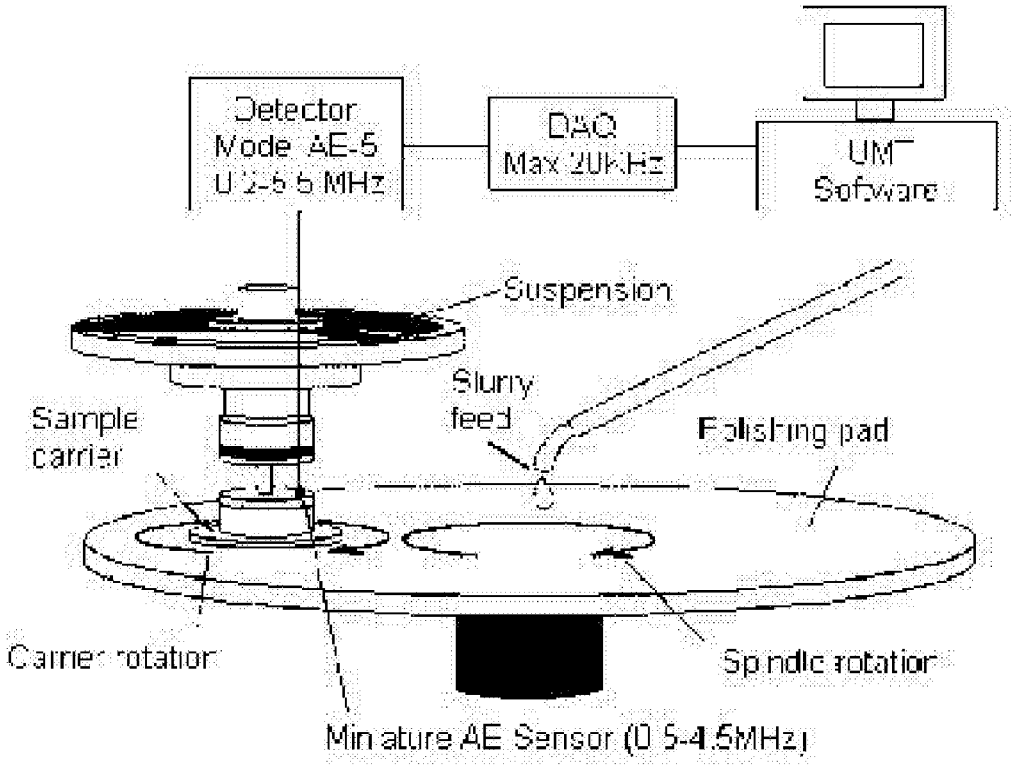
Fig. 1 Prior Art
FIG. 1 is a diagram illustrating the chemical mechanical planarization process as known in the art.
Figure 2:
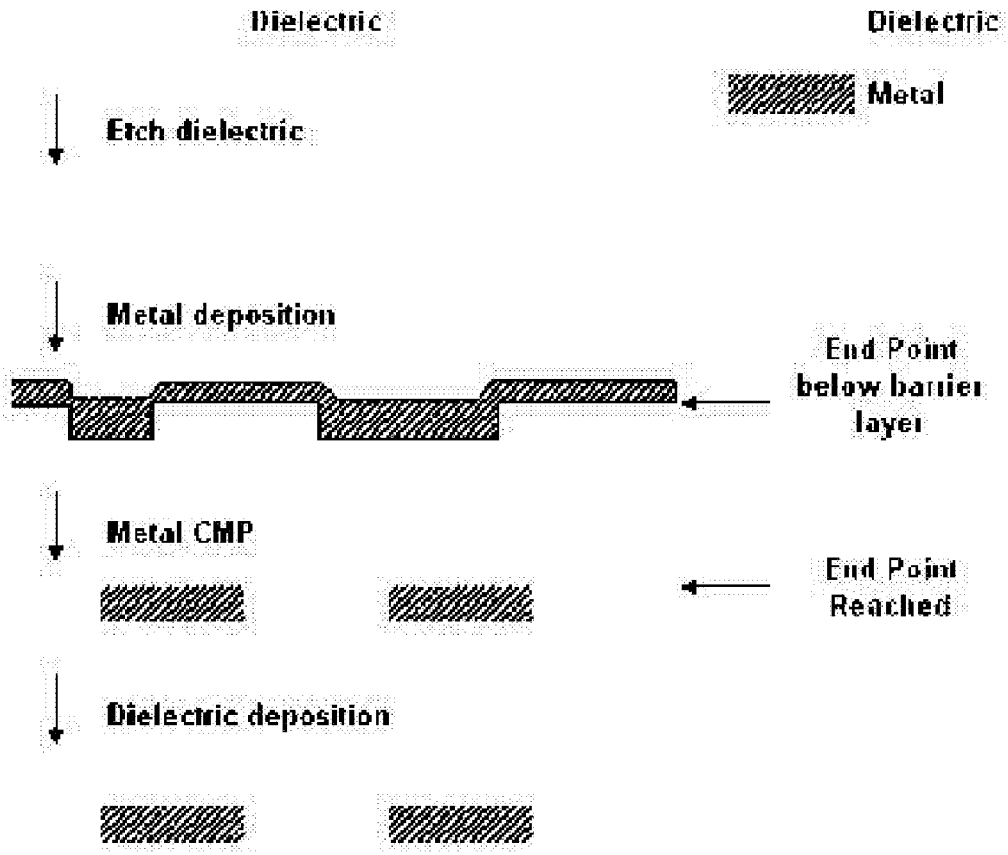
Fig. 2 Prior Art
FIG. 2 is a schematic illustration of a metal chemical mechanical planarization as is known in the art.
Figure 3:
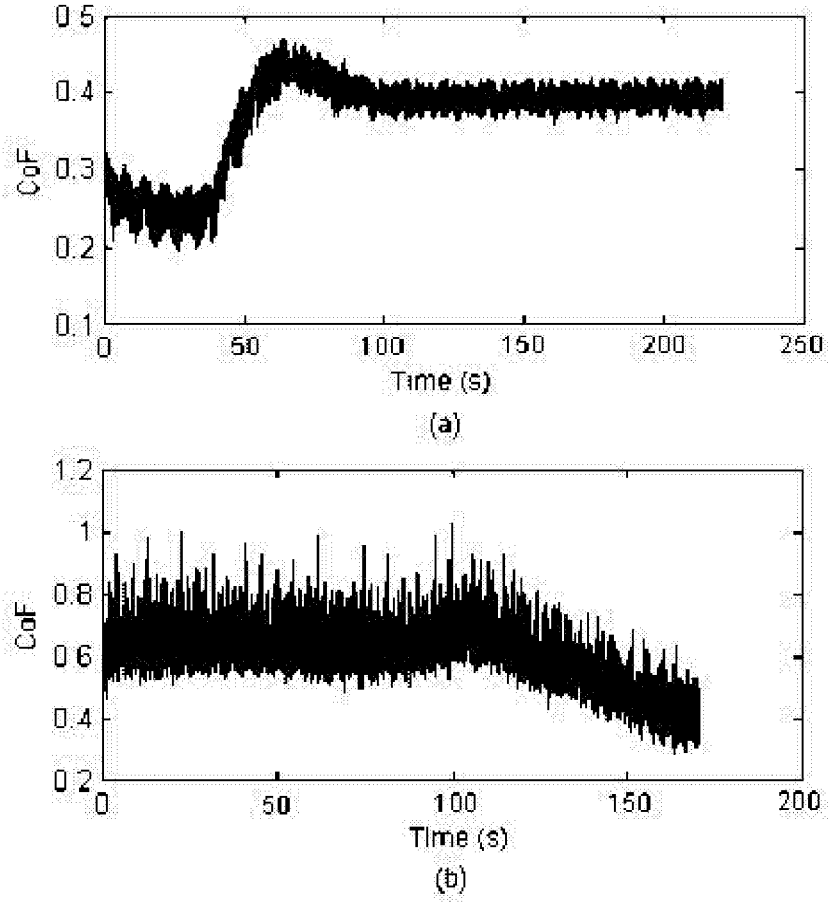
FIG. 3(*a*) is a graphical illustration of raw data from an oxide CMP at 200 rpm and 8 psi. (b) is a graphical illustration of raw data from Cu metal CMP at 100 rpm and 2 psi.
Figure 4:
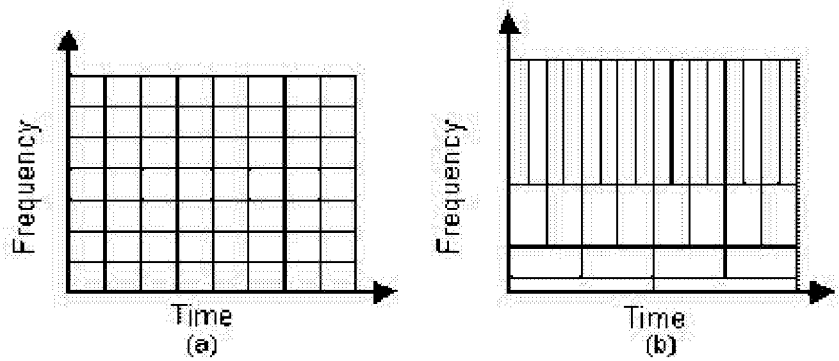
FIG. 4(*a*) is a graphical illustration of a sequential probability ratio test with a fixed aspect ratio. (b) is a graphical illustration of a wavelet transform with a variable aspect ratio.

Acoustic emission (AE) and coefficient of friction (CoF) sensors are known in the art to be used in process monitoring for EPD by measuring various properties including amplitude of the signal, and the frequency of the spectral peaks. Since these properties differ between materials, they can be used to detect transitions from one layer to another during CMP. The presence of noise and the need for advanced signal processing has kept these approaches from being commercially implemented. As shown with reference to FIG. 3(*a*) and FIG. 3(*b*), the CoF data collected and analyzed for EPD is sampled at a fairly high frequency (1 kHz) and is corrupted with noise. More specifically, FIG. 3(*a*) is a graphical illustration of raw data from an oxide CMP at 200 rpm and 8 psi and FIG. 3(*b*) is a graphical illustration of raw data from Cu metal CMP at 100 rpm and 2 psi. As such, the raw data must be denoised, separated into frequency bands and analyzed using time-domain methods at each frequency band. Thus, a direct statistical analysis of the time domain CoF data would yield poor results unless the noise component is removed and the significant features are extracted. Conventional time domain analysis methods, which are sensitive to impulsive oscillations, have limited utility in extracting hidden patterns and frequency related information in these signals. This problem has been partially overcome by spectral analysis such as Fourier transform, the power spectral density, and the coherence function analysis. However, many spectral methods rely on the implicit fundamental assumption of signals being periodic and stationary, and are also inefficient in extracting time related features. Moreover, Fourier transform of nonstationary signals results in averaging of the frequency components over the entire duration of the signal. This problem has been addressed to a large extent through the use of time-frequency-based short-time Fourier transform (STFT) methods. However, as shown with reference to FIG. 4(*a*), this method uses a fixed tiling scheme, i.e., it maintains a constant aspect ratio such that the width of the time window to the width of the frequency band is constant throughout the analysis. As a result, one must choose multiple window widths to analyze different data features localized in time and frequency domains in order to determine the suitable width of the time window. STFT is also inefficient in resolving short-time phenomena associated with high frequencies since is has a limited choice of wave forms. In recent years, another time-frequency, or time-scale, method known as wavelet-based multiresolution analysis has gained popularity in the analysis of both stationary and nonstationary signals. Wavelet-based multiresolution analysis provides excellent time-frequency localized information, which is achieved by varying the aspect ratio, as shown with reference to FIG. 4(*b*). This means that multiple frequency bands can be analyzed simultaneously in the form of details and approximations plotted over time. As such, different time and frequency localized features are revealed simultaneously with high resolution. Accordingly, wavelet-based multiresolution analysis is easily adaptable to signals with short-time features occurring at higher frequencies.

The fundamental concept behind signal processing with wavelets is that the signals can be decomposed into constituent elements through the use of basis functions. These basis functions can be obtained from the scaled (dilated) and shifted (translated) versions of the mother wavelet (w). The wavelet analysis uses linear combinations of basis functions (wavelets), localized in both time and frequency, to represent any function in the $L^2(R)$ Hilbert space. For example:

$$f(t) = \sum_{j=-\infty}^{\infty} \sum_{k=-\infty}^{\infty} b_{j,k} w_{j,k}(t) j,\ k \in Z$$

where j and k are dilation, or scale, and translation indices, respectively, $^{w}$j.k denotes a collection of basis functions, $^{b}$j.k are the coefficients of these functions, and Z denotes the set of integers. The wavelet basis functions can also be derived from the dilation and translation of scaling functions (ϕ) that span $L^2(R)$. By combining the scaling and the wavelet functions, any class of signals in $L^2(R)$ can be represented as:

$$f(t) = \sum_{k=-\infty}^{\infty} c_{j_0,k} \phi(1-k) + \sum_{k=-\infty}^{\infty} \sum_{j=j_0}^{\infty} d_{j,k} w(2^j t - k)$$

where $^{c}$j$_o$.k and $^{d}$j.k are coefficients for the scaling (approximations) and wavelet (details) functions, respectively. They are also called the discrete wavelet transform (DWT) of the function f(t), and it is customary to start with $j_o$=0. If the wavelet system is orthogonal, then the coefficients can be calculated by:

$$c_{j_0,k} = \langle f(t), \phi_{j_0,k}(t) \rangle = \int f(t) \phi_{j_0,k}(t) dt$$

$$d_{j,k} = \langle f(t), w_{j,k}(t) \rangle = \int f(t) w_{j,k}(t) dt$$

However, fast wavelet transforms (FWT) are used in practice. The coefficients are derived using the cascade (pyramid) algorithm, in which the next level coefficients are derived from the previous level. If the signal is smooth, the coefficients are small in magnitude. However, if there is a jump in the signal the magnitude of the coefficients will show a significant increase. The abrupt change in a process can be detected using the extrema of the wavelet coefficients.

The role of statistical quality control is to provide decision tools that support production and maintenance activities, and this is achieved through a quality monitoring system (QMS). It is well known that the details from wavelet reconstruction are usually very small in magnitude and changes in these details due to an assignable cause are even smaller. Thus, it is essential to have a very sensitive and efficient QMS that can be implemented in real-time. This requirement is met in the present invention through the use of control charts that utilize a sequential probability ratio test (SPRT). Another important property of the SPRT is its optimality in reference to the average sampling number (ASN). The SPRT requires that the data be normally distributed with no autocorrelation. As such, in accordance with the present invention SPRT is applied to the variance of the reconstructed wavelet details of the CoF data to provide a very sensitive and efficient quality control monitoring system for the chemical mechanical planarization process that can be implemented in real-time.

The sequential probability ratio test was designed by Wald as a statistical tool for deciding between two simple hypotheses. According to Wald, if a random variable X is distributed $f(\chi,\theta)$, it is possible to test the simple hypothesis $H_0$: $\theta=\theta_0$ with $H_1$: $\theta=\theta_1$ using SPRT. This test is based on the Neyman-Pearson (N-P) Lemma, which states that, for a fixed sample size of n, the optimal design, and as such the most powerful test, for a simple hypothesis can be obtained from the likelihood ratio ($\lambda$n)as follows:

Accept $H_0$, if $\lambda_n < k$

Accept $H_1$, if $\lambda_n \geq k$ where, $$\lambda_n = \prod_{i=1}^{n} \frac{f(x_i, \theta_1)}{f(x_i, \theta_0)}$$

k is the decision limit associated with level of significance $\alpha$ (size of the critical region), and i denotes the observation index.

The SPRT for variance based on N-P Lemma uses two decision limits, upper and lower, instead of one. Consequently, there are three decision zones. The hypothesis for the test of variance when the means is know is set as follows:

$H_0: \sigma^2 = \sigma_0^2$ $H_1: \sigma^2 = \sigma_1^2 (\sigma_0^2 < \sigma_1^2)$ For a population $X = N(\mu, \sigma^2)$, where $\sigma_0$ and $\sigma_1$ are design parameters for in-control and out-of-control standard deviation values. Suppose that, after n−1 observations, the test has indicated that there is no evidence for accepting or rejecting $H_0$. Define, $\lambda^{\sigma}_n$ the nth likelihood ratio for testing the variance as:

$$\lambda_n^{\sigma} = \frac{L(x_1, x_2 \ldots x_n : \mu, \sigma_1^2)}{L(x_1, x_2 \ldots x_n : \mu, \sigma_0^2)}.$$

The three decision criteria are as follows.

Accept $H_0$(Reject $H_1$). if $\lambda_n^{\sigma} < \alpha_{\sigma}$

Reject $H_0$(Accept $H_1$). if $\lambda_n^{\sigma} > b_{\sigma}$

Keep on sampling. if $\alpha_{\sigma} \leq \lambda_n^{\sigma} \leq b_{\sigma}$

Where $\alpha_{\sigma}$ and $b_{\sigma}$ are design variables. The region between $\alpha_{\sigma}$ and $b_{\sigma}$ limits are also referred to as the zone of indifference. Wald also shows that the approximate magnitude of $\alpha$ and $\beta$ errors associated with a test can be obtained using just the detection limits $\alpha_{\sigma}$ and $b_{\sigma}$ as $$\alpha \approx \frac{1 - a_{\sigma}}{b_{\sigma} - a_{\sigma}}$$

$$\beta \approx \frac{a_{\sigma}(b_{\sigma} - 1)}{b_{\sigma} - a_{\sigma}}.$$

Using log-likelihood ratio, the SPRT for the variance with known mean can be restated as follows:

Accept $H_0$.

$$\text{if } \sigma_n^2 < \frac{R_1}{R_2} + \frac{h_{\sigma}}{nR_2}$$

Reject $H_0$.

$$\text{if } \sigma_n^2 > \frac{R_1}{R_2} + \frac{k_{\sigma}}{nR_2}$$

Keep on sampling.

$$\text{if } \frac{R_1}{R_2} + \frac{h_{\sigma}}{nR_2} \leq \sigma_n^2 \leq \frac{R_1}{R_2} + \frac{k_{\sigma}}{nR_2}$$

where $$h_{\sigma} = \ln(a_{\sigma})$$

$$k_{\sigma} = \ln(b_{\sigma})$$

$$R_1 = \ln\left(\frac{\sigma_1}{\sigma_0}\right)$$

$$R_2 = \frac{1}{2}\left(\frac{1}{\sigma_0^2} - \frac{1}{\sigma_1^2}\right)$$

$$\sigma_n^2 = \frac{\sum_{k=1}^{n} (x_k - \mu)^2}{n}$$

Where $x_k$ is the value of the k th wavelet detail, $\mu$ is the mean of the wavelet detail, and n is the sample size.

One of the requirements for online implementation is matching the data analysis with the data acquisition. In order to meet this requirement, it is known in the art to employ a strategy in which real-time data is processed in short windows of dyadic length. Two forms of moving window strategies known in the art are the one step moving window strategy and the moving block strategy. In the one step moving window strategy, the window is moved to add one new data point and the window width is kept constant by removing the oldest point in the window. The advantage of this strategy is that every point in the data set, except some points in the very first window, is at the dyadic location during wavelet decomposition and is well represented at every level. However, this method is inefficient for online implementation due to its high computational time and is, thus, well suited for an offline analysis. The computational time can be drastically reduced by employing the moving block strategy. In the moving block strategy, incoming data from the process is grouped into non-overlapping blocks of chosen dyadic length. Data analysis begins as soon as the first block of data is collected. This process of data grouping in blocks, followed by analysis of the blocks, is repeated until the process ends. Such a strategy, though computationally efficient, lacks the benefit of every point in the block being at the dyadic location during wavelet decomposition. As such, a short-time delay in representing significant features at coarser scales of decomposition, since a significant process disturbance is likely to be seen first at the finer scales before appearing at the coarser scales. This short-time delay, however, is made trivial by the high computational speed and also the high rate of data sampling that allows better representation of the features.

The variance of the wavelet details always increases whenever there is a change (increase or decrease) in the CoF values. In accordance with the present invention, the end point event is detected by applying SPRT on the variance of the wavelet details. Accordingly, only the upper control limit is needed to detect an increase in variance, and the region below the upper limit is the zone of indifference. The SPRT for variance as a test for end point can be given as follows:

Reject $H_0$(Accept $H_1$: End point reached)

$$\text{if } \sigma_n^2 > \frac{R_1}{R_2} + \frac{k_\sigma}{nR_2}$$

Keep on sampling $$\text{if } \sigma_n^2 \le \frac{R_1}{R_2} + \frac{k_\sigma}{nR_2}$$

where $R_1$, $R_2$, $\sigma_n^2$, and $k_\sigma$ are as earlier defined.

The design parameters of the SPRT chart are $\sigma_0$, $\sigma_1$, $\alpha$, and $\beta$. Since only the upper control limit is of concern here, $\beta$ error need not be considered in the SPRT test design. The values for $\sigma_0$ and $\sigma_1$ are chosen according to the procedure followed in standard s control chart of statistical quality control literature as known in the art. These are given as follows:

$$\sigma_1 = \bar{S} + 3\bar{S}\frac{\left(\sqrt{1-c_4^2}\right)}{c_1}$$

$$\sigma_0 = \bar{S} + 2.95\bar{S}\frac{\left(\sqrt{1-c_4^2}\right)}{c_4}$$

where $c_1$=4(n−1)/(4n−3) is a constant which depends on the sample size n, and $\bar{S}$ is the mean value of the standard deviation of wavelet details. Since only the upper limit of SPRT is needed, any value of $\sigma_0$ can be chosen such that $\sigma_0<\sigma_1$. However, in a particular embodiment of the present invention, maintaining $\sigma_0$ and $\sigma_1$ as identified in the above equations was shown to offer good EPD performance for both oxide and copper metal CMP. Additionally, the coefficient values of 3 and 2.95 used in the above equations were established based on the data collected from the process after the initial transient period and before the end point. This is customary in statistical quality control procedures that use s control chart. For a given CMP set up and parameters, these coefficients must be established.

Figure 5:
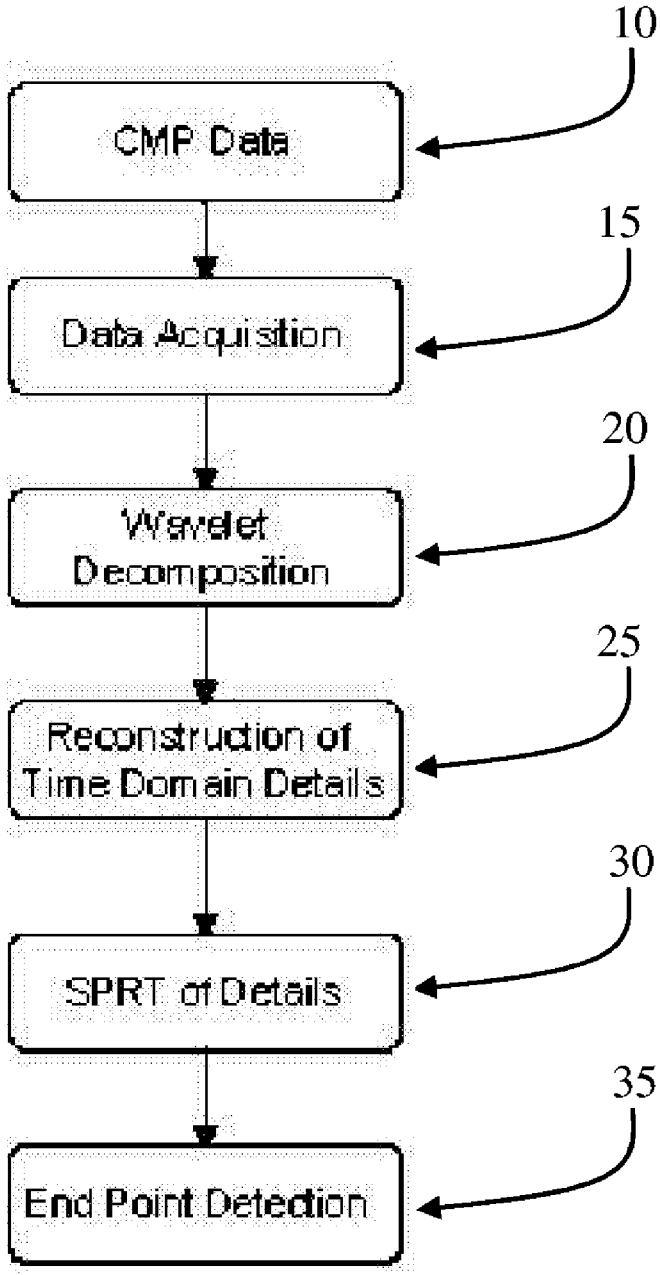
FIG. 5 is a flow diagram illustrating the online methodology for end point detection in a chemical mechanical planarization process in accordance with the present invention.

The online methodology in accordance with the present invention is illustrated with reference to FIG. 5. Using the data acquisition system, CMP data 10 is acquired from the CMP process 15 and the first dyadic block is formed. The data is then wavelet decomposed into coefficients 20 and reconstructed into the time-domain wavelet details 25. The level of decomposition is decided based on the data type. Standard deviation of the wavelet details for the first data block is calculated and is assigned to the:

$\bar{S}$ value, which is used to calculate $\sigma_0$ and $\sigma_1$. The SPRT upper limit is then determined and the variance of the wavelet details is plotted against this limit. The variance at any point is the variance of all the preceding wavelet details until the current one. When a new data block is created, the standard deviation of the wavelet details for the new block is calculated and the:

$\bar{S}$ value is reset to the average of the standard deviations of the current and all of the past blocks. The new value of:

$\bar{S}$ is used to calculate new values of $\sigma_0$ and $\sigma_1$, and also the corresponding SPRT limit. The variance of the wavelet details at any point of the new block is calculated 30 by considering all details from the start of the previous block until the current point. Thus, the maximum number of details (n) used in the variance calculation is limited to twice the size of the block. This allows the removal of all details prior to the current and the most recent block, which helps in maintaining the computational speed. It is also observed that as SPRT proceeds, both $\sigma_0$ and $\sigma_1$ values stabilize as the value of:

$\bar{S}$ stabilizes. Even though the upper control limit for every block is drawn from the data itself, the averaging of:

$\bar{S}$ makes the limit robust against fluctuations in the details. Thus, when a significant event such as end point occurs 35, the increased value of the variance of the wavelet details exceeds the upper control limit of the SPRT chart, indicating the beginning of the end of planarization. When the end of planarization (e.g., transition to the dielectric layer for metal CMP) is reached, the variance falls below the upper limit. It is seen that, the above procedure develops the SPRT limit from the test data unlike the conventional statistical methods in which a separate in-control data set is required to derive the control limits. Thus, the method in accordance with the present invention can be readily adapted to EPD under different CMP process conditions.

The online EPD methodology in accordance with the present invention requires the selection of design parameter values. In an exemplary embodiment illustrating the selection of these design parameter values, the metal CMP data was first acquired from both blanket and patterned wafers. Several data sets were collected from wafers planarized under different combinations of rotational speed (50-300 rpm) and downward pressure (1-8 psi), while maintaining the same slurry composition and pad materials. Coefficient of friction data was then collected at 1 kHz for both oxide and copper (blanket and patterned) CMP. The wafers used were backed with a new generation low-k dielectric material, and the copper metal CMP wafer had a tantalum nitride (TaN) barrier layer. The polishing pads were of type IC 1000/SUBA IV. The polished wafers were also examined using a scanning electron microscope (SEM) to ensure both complete and defect free CMP. Wavelet-based multiresolution analysis, followed by variance SPRT, in accordance with the present invention, was then applied on these collected data sets to assess the efficacy of the EPD approach presented.

Figure 6:
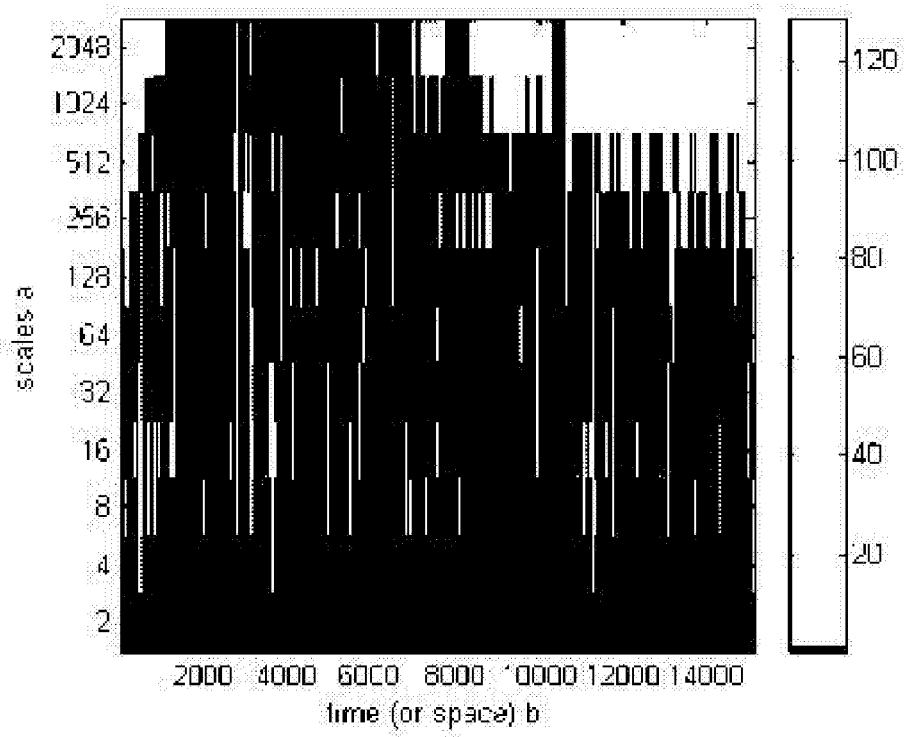
FIG. 6(*a*) is an illustration on an unthresholded wavelet coefficient. (b) is an illustration of a thresholded wavelet coefficient in accordance with the present invention.
Figure 6:
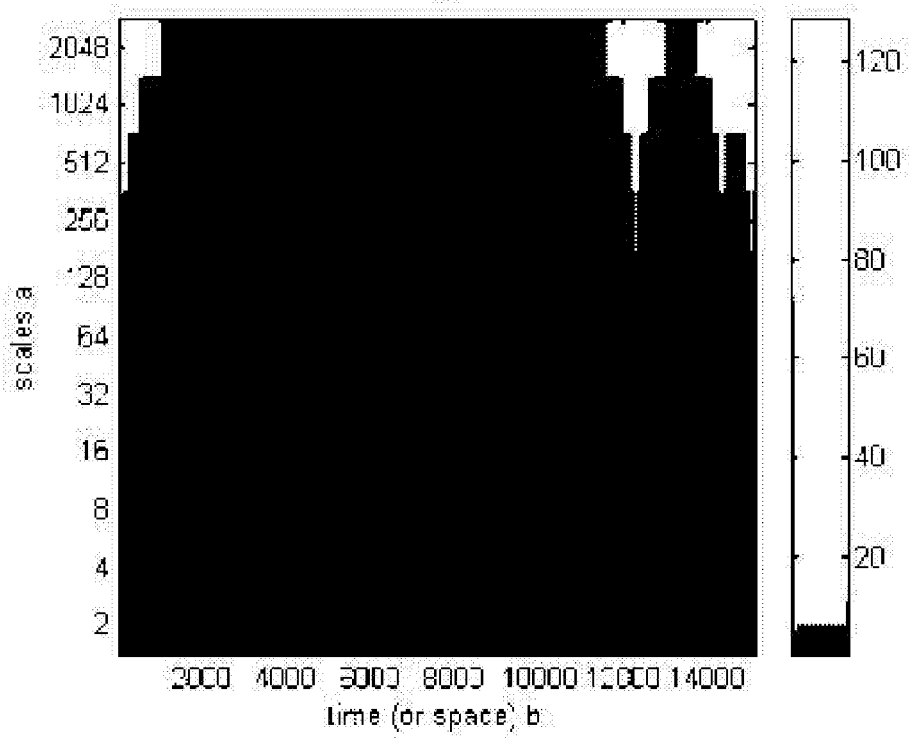
Figure 7:
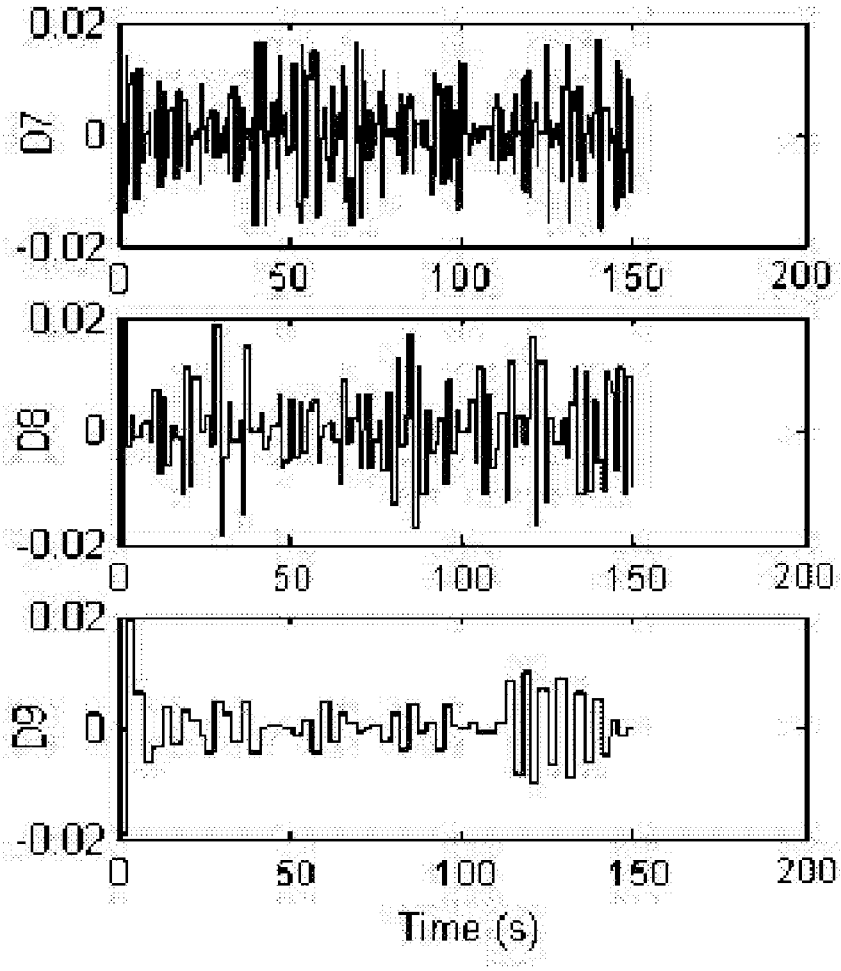
FIG. 7 is an illustration of the unthresholded wavelet details from level 7-9 in accordance with the present invention.

In this particular exemplary embodiment, the parameter $\alpha$ was chosen to be 0.01. Wavelet decomposition was performed using Harr wavelets, which are step functions, since the CoF is not a smooth signal. A dyadic block width of 512 was selected, which allows nine levels of decomposition. SPRT for variance was applied to the details of the ninth level of decomposition. The selection of this level was made by applying Donoho's universal threshold rule and observing for significant coefficients. The unthresholded wavelet coefficients in accordance with this exemplary embodiment are shown in FIG. 6(*a*) and the thresholded wavelet coefficients are shown in FIG. 6(*b*). As show with reference to FIG. 6(*b*), the significant coefficients exist only at levels eight (labeled as 256, which is $2^8$) and above. However, a separate plot of the unthresholded wavelet details from level 7-9, as shown in FIG. 7, reveals that level 8 contains noise and, hence, is not suitable for end point analysis. Use of higher levels of detail for data interpretation generally results in errors, since coarser scales have fewer coefficients. Thus, details at level 9 were chosen for SPRT application in this exemplary embodiment, and it was observed that EPD, being a time-localized feature, was well captured at this low-frequency level. Accordingly, details at levels 7-9 must be investigated to arrive at the appropriate level(s) for applying SPRT.

Figure 8:
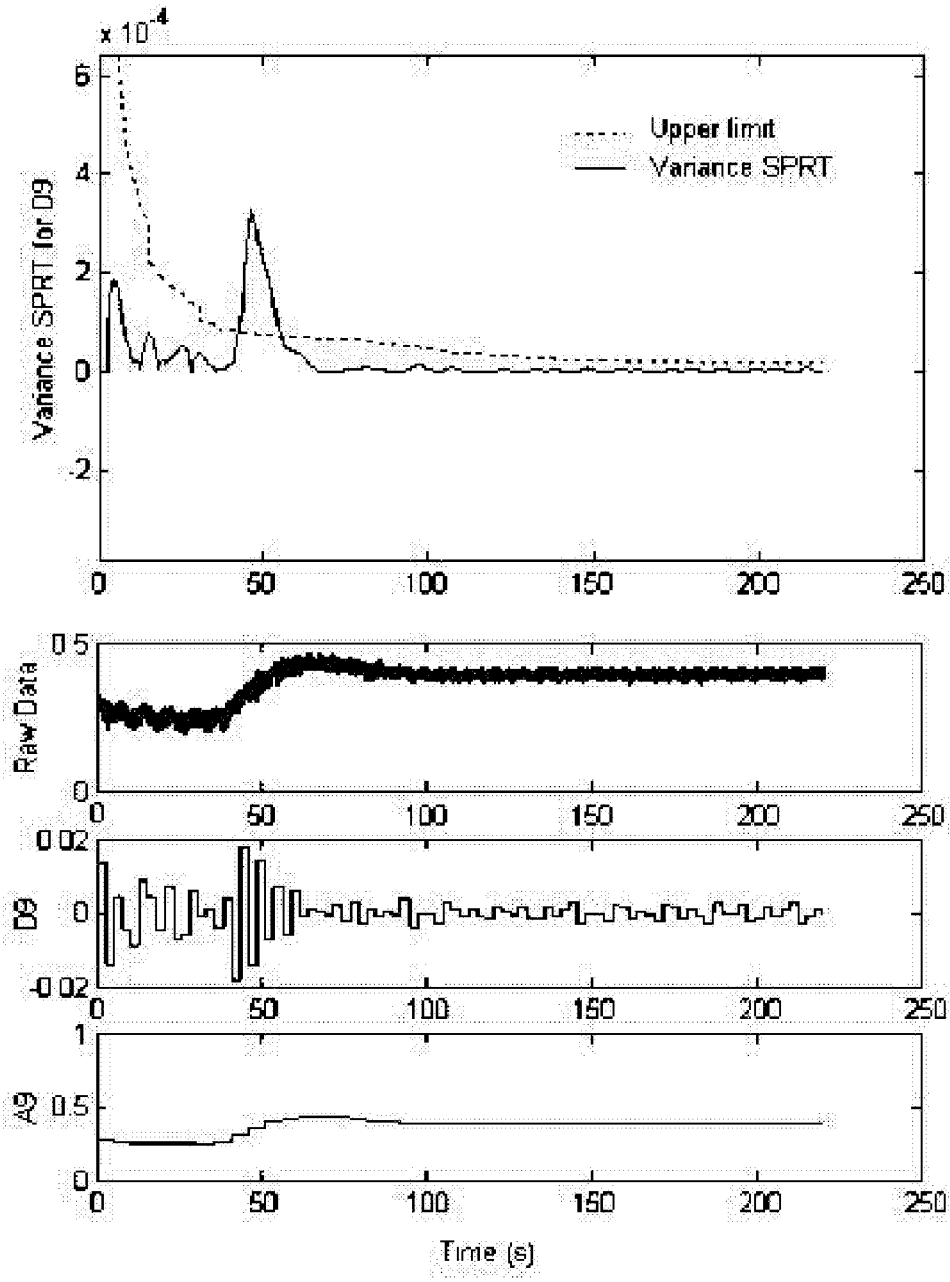
FIG. 8 is an illustration of the variance sequential probability ratio test for oxide chemical mechanical planarization in accordance with the present invention.
Figure 9:
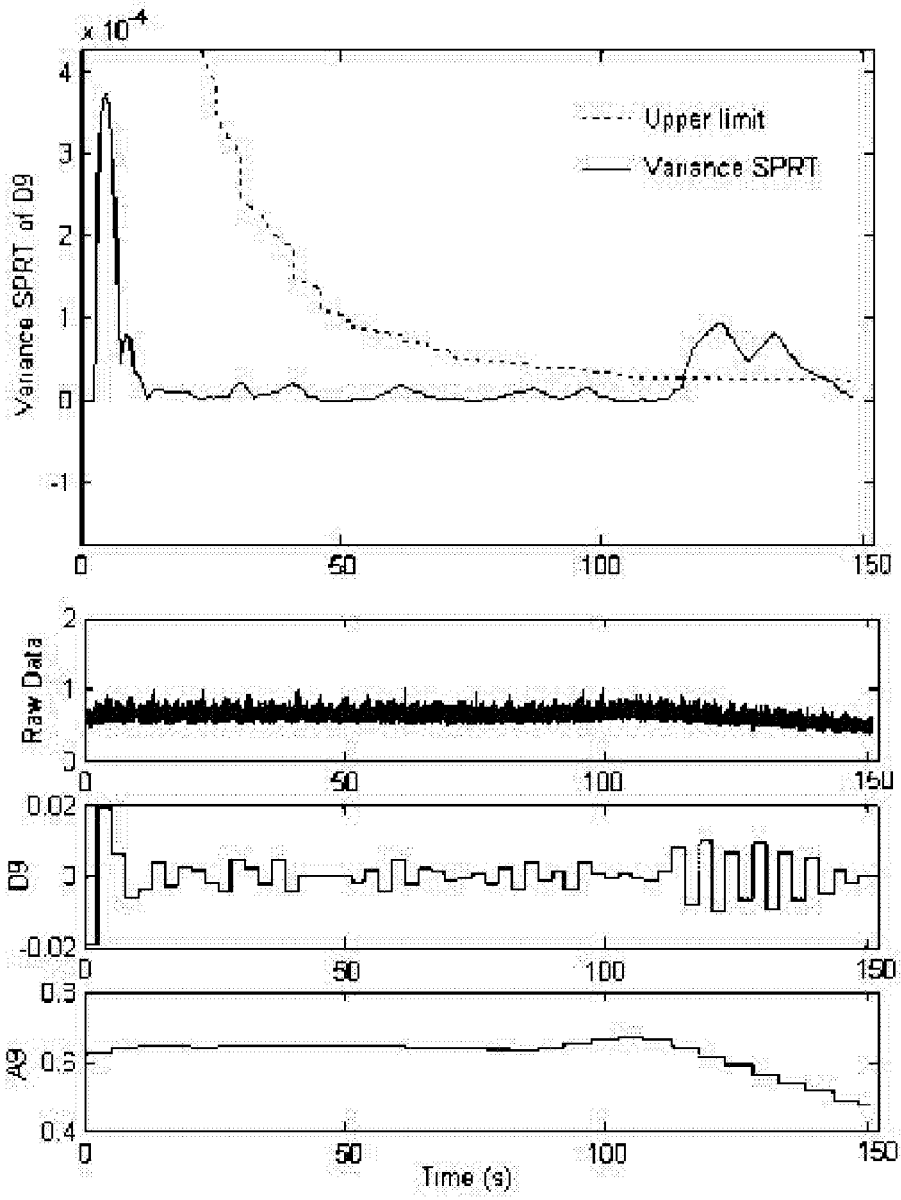
FIG. 9 is an illustration of the variance sequential probability ratio test for copper metal mechanical planarization of a blanket wafer in accordance with the present invention.
Figure 10:
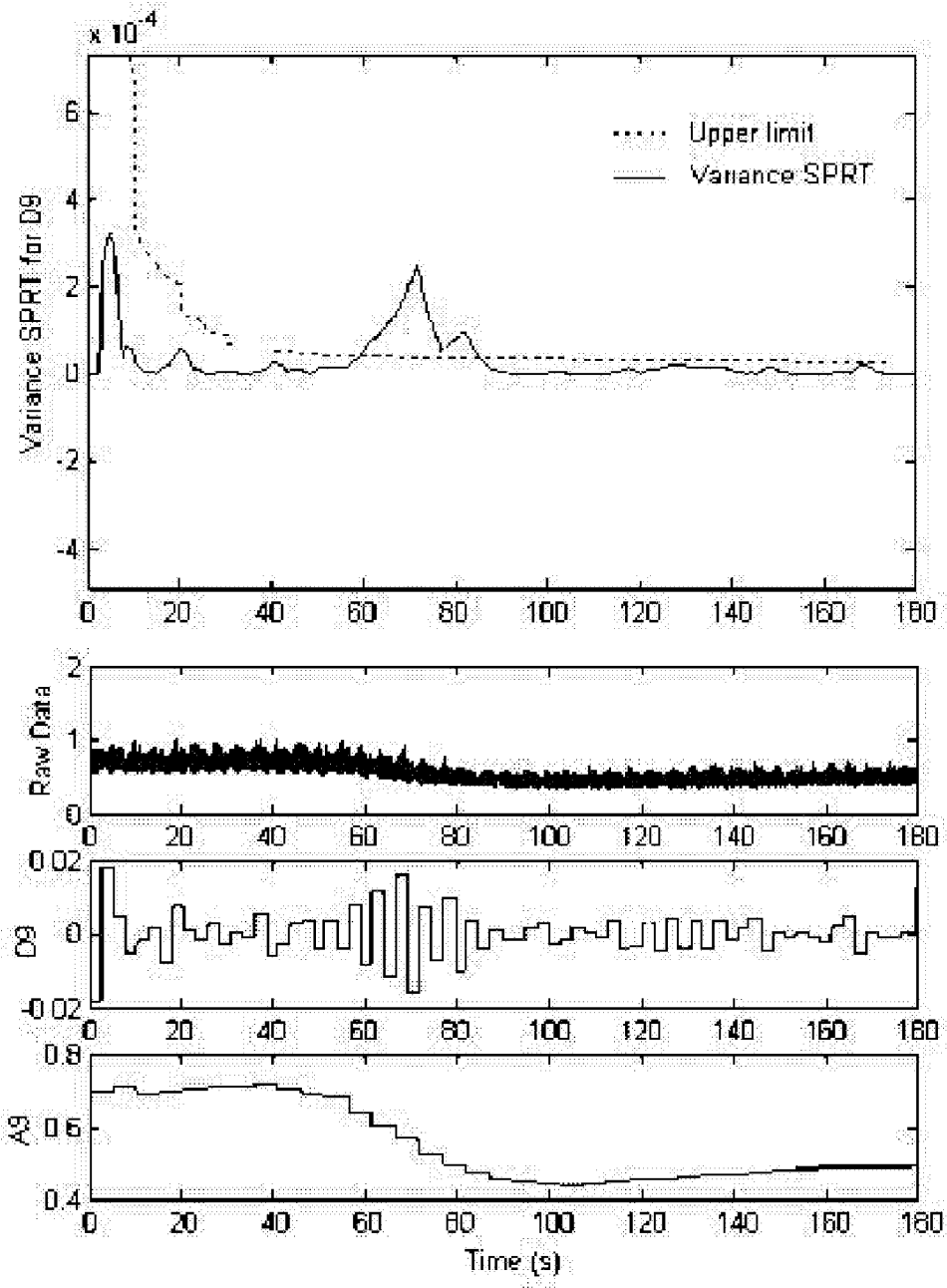
FIG. 10 is an illustration of the variance sequential probability ratio test for copper metal mechanical planarization of a patterned wafer in accordance with the present invention.

FIG. 8 illustrates a plot of variance SPRT for oxide CMP at 200 rpm and 8-psi downward pressure. The underlying layer below silicon dioxide ($SiO_2$) was silicon (Si). The figure also shows plots of the raw data, and the detail and approximation at level 9. Though these plots seem to generally indicate the region of end point, it is the variance SPRT plot that accurately pinpoints the start and finish of the end point event. However, it may be noted that the indications obtained from plots other than the variance SPRT are often not as explicit, which can be seen in FIG. 9 and FIG. 10. FIG. 9 illustrates SPRT for copper metal CMP for a blanket wafer in a damascene process at 100 rpm and 2-psi downward pressure. In this wafer, a barrier layer (TaN) was also present, and the underlying layer was $SiO_2$. The event of transition from metal into the barrier layer is indicated by the first of the two peaks reaching above the control limit on the SPRT chart, and the second peak indicates the transition from barrier to $SiO_2$. A similar trend can be observed with a patterned copper wafer (30% pattern density) planarized at 100 rpm pad velocity and 3-psi downward pressure, as shown with reference to FIG. 10. The plots show extreme sensitivity of the variance SPRT to the end point event. The tests were also conducted for data collected under different rotational velocity and downward pressure, for which similar results were obtained.

The present invention presents a novel end point detection methodology that analyzes signals from molecular activity using multiresolution decomposition and variance SPRT. The EPD methodology in accordance with the present invention is also capable of real-time implementation by matching the data analysis rate with the rate of data acquisition. The present invention is capable of clearly identifying the start and finish of the end point events for a variety of CMP processes. Additionally, the ease of collecting CoF data from CMP processes and its subsequent analysis using codes developed on the widely available MATLAB toolbox makes the methodology of the present invention viable for commercialization.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A method of identifying an end point of polishing in a chemical mechanical planarization process, the method comprising the steps of:

wavelet decomposing the coefficient of friction data acquired from the chemical mechanical planarization process to obtain a plurality of wavelet coefficients;

testing an energy content of each of the plurality of wavelet coefficients to identify a plurality of wavelet coefficients having a significant frequency level;

applying thresholding rules to the plurality of wavelet coefficients identified as having a significant frequency level to obtain a plurality of thresholded wavelet coefficients having a significant frequency level;

reconstructing a plurality of time-domain wavelet details from the plurality of thresholded wavelet coefficients; and applying a sequential probability ratio test for variance on the reconstructed time-domain wavelet details to identify the endpoint of polishing in the chemical mechanical planarization process.

2. The method of claim 1, further comprising the step of grouping the acquired coefficient of friction data into at least one nonoverlapping data block having a predetermined dyadic length prior to decomposing the data.

3. The method of claim 1, wherein the step of wavelet decomposing coefficient of friction data acquired from a chemical mechanical planarization process further comprises determining a level of decomposition for the decomposition of the coefficient of friction data.

4. The method of claim 3, wherein the step of determining the level of decomposition further comprises the steps of:

determining the level of decomposition based on the plurality of wavelet coefficients identified as having a significant frequency level.

5. The method of claim 1, wherein the threshold rule is Donoho's universal threshold rule.

6. The method of claim 1, wherein the sequential probability ratio test for variance applied is Wald's sequential probability ratio test for variance.

7. The method of claim 1, wherein the chemical mechanical planarization process is an oxide chemical mechanical planarization process in which there is a transition from one material to another.

8. The method of claim 1, wherein the chemical mechanical planarization process is a metal chemical mechanical planarization process in which there is a transition from one material to another.

9. The method of claim 1, wherein the wavelet used to decompose is Harr's wavelet.

10. The method of claim 1, wherein the identification of the endpoint indicates a transition from one material to another in the chemical mechanical planarization process.

11. The method of claim 1, further comprising the step of acquiring coefficient of friction data from the chemical mechanical planarization process by sampling.

12. A computer-implemented process for identifying an endpoint of polishing in a chemical mechanical planarization process, the method comprising the steps of:

wavelet decomposing the coefficient of friction data acquired from the chemical mechanical planarization process to obtain a plurality of wavelet coefficients;

testing an energy content of each of the plurality of wavelet coefficients to identify a plurality of wavelet coefficients having a significant frequency level;

applying thresholding rules to the plurality of wavelet coefficients identified as having a significant frequency level to obtain a plurality of thresholded wavelet coefficients having a significant frequency level;

reconstructing a plurality of time-domain wavelet details from the plurality of thresholded wavelet coefficients; and applying a sequential probability ratio test for variance on the reconstructed time-domain wavelet details to identify the endpoint of polishing in the chemical mechanical planarization process.

13. A system for identifying an endpoint of polishing in a chemical mechanical planarization process, the system comprising:

a decomposer for wavelet decomposing the coefficient of friction data acquired from the chemical mechanical planarization process to obtain a plurality of wavelet coefficients;

an energy tester for testing an energy content of each of the plurality of wavelet coefficients to identify a plurality of wavelet coefficients having a significant frequency level;

a thresholder for applying thresholding rules to the plurality of wavelet coefficients identified as having a significant frequency level to obtain a plurality of thresholded wavelet coefficients having a significant frequency level;

a reconstructor reconstructing a plurality of time-domain wavelet details from the plurality of thresholded wavelet; and a sequential probability ratio tester for applying a sequential probability ratio test for variance on the reconstructed time-domain wavelet details to identify the endpoint of polishing in the chemical mechanical planarization process.

14. A computer readable storage medium executed by a processor for identifying an endpoint of polishing in a chemical mechanical planarization process, the computer readable storage medium comprising:

a first plurality of binary values for wavelet decomposing the coefficient of friction data acquired from the chemical mechanical planarization process to obtain a plurality of wavelet coefficients;

a second plurality of binary values for testing an energy content of each of the plurality of wavelet coefficients to identify a plurality of wavelet coefficients having a significant frequency level;

a third plurality of binary values for applying thresholding rules to the plurality of wavelet coefficients identified as having a significant frequency level to obtain a plurality of thresholded wavelet coefficients having a significant frequency level;

a fourth plurality of binary values for reconstructing plurality of time-domain wavelet details from the plurality of thresholded wavelet; and a fifth plurality of binary values for applying a sequential probability ratio test for variance on the reconstructed time-domain wavelet details to identify the endpoint of polishing in the chemical mechanical planarization process.

* * * * *